US008037946B2

(12) United States Patent
Robson

(10) Patent No.: US 8,037,946 B2
(45) Date of Patent: Oct. 18, 2011

(54) HAMMER ASSEMBLY

(75) Inventor: Angus Peter Robson, Matamata (NZ)

(73) Assignee: Terminator IP SA, Luxembourg (LU)

( * ) Notice: Subject to any disclaimer, the term of this patent is extended or adjusted under 35 U.S.C. 154(b) by 607 days.

(21) Appl. No.: 11/914,551

(22) PCT Filed: May 16, 2006

(86) PCT No.: PCT/NZ2006/000115

§ 371 (c)(1),
(2), (4) Date: Jul. 7, 2008

(87) PCT Pub. No.: WO2006/123948

PCT Pub. Date: Nov. 23, 2006

(65) Prior Publication Data

US 2009/0129863 A1 May 21, 2009

(30) Foreign Application Priority Data

May 16, 2005 (NZ) ..... 540097
Nov. 22, 2005 (NZ) ..... 543739

(51) Int. Cl.
*E21C 37/00* (2006.01)

(52) U.S. Cl. ..... 173/190

(58) Field of Classification Search ..... 299/69, 299/100, 37.3; 173/90, 91, 190
See application file for complete search history.

(56) References Cited

U.S. PATENT DOCUMENTS 4,602,821 A * 7/1986 Schaeff ..... 299/67
4,719,975 A * 1/1988 LaBounty ..... 173/46
5,183,316 A * 2/1993 Ottestad ..... 299/69
6,129,298 A * 10/2000 Nye ..... 241/101.73
7,124,838 B2 * 10/2006 Stewart et al. ..... 173/25

FOREIGN PATENT DOCUMENTS

DE 19741049 C1 * 3/1999
JP 10025707 A * 1/1998

* cited by examiner

*Primary Examiner* — Sunil Singh
(74) *Attorney, Agent, or Firm* — SNR Denton US LLP

(57) ABSTRACT

A hammer assembly (1) for breaking, levering and raking material, the hammer assembly includes a hammer (1) and an articulated control linkage (3). The hammer includes: a movable mass capable movement along an impact axis (14), an elongated 5 tool (23) having a longitudinal axis substantially parallel or coaxial with the impact axis(4), a primary pivot (6) attachment point for attaching the hammer (1) to a distal end of an operating arm (2) attached to the carrier for pivotal movement of the hammer (1) about a primary axis (6) orthogonal to the impact axis (14). The control linkage (3) includes first (4) and second linkss (5) for effecting pivotal movement of the hammer (1) about the primary axis (6) in response to movement from a drive attached to the operating arm (2).

21 Claims, 8 Drawing Sheets

HAMMER ASSEMBLY

CROSS-REFERENCE TO OTHER APPLICATIONS

This is a National Phase of International Application No. PCT/NZ2006/000115 filed on May 16, 2006, which claims priority from New Zealand Patent Application No. 540097 filed on May 16, 2005 and New Zealand Patent Application No. 543739 filed on Nov. 22, 2005.

TECHNICAL FIELD

The invention relates to a breaking tool, with a raking and levering capacity, in addition to a linear impact hammer, and an attachment means for same.

In particular, the present invention relates to a breaking tool adapted for attachment to known plant machinery including excavators, wheeled loaders and the like Reference throughout the specification is made to the invention as relating to breaking tools in the form of gravity drop hammers although this should not be seen as limiting.

BACKGROUND ART

Gravity drop hammers are primarily designed for surface breaking of exposed rock and generally consist of a weight capable of being raised to a height within a housing before release. The weight falls under gravity to strike a surface to be broken, either directly (thus protruding through an aperture in the hammer housing) or indirectly via a striker pin.

The present invention is discussed herein with respect to rock breaking devices produced by the applicant including the devices described in PCT/NZ03/000236 and PCT/NZ03/000237 featuring a drop hammer lock and drive mechanism for a powered drop hammer respectively. U.S. Pat. No. 4,383,363 describes a rock breaking apparatus known as, and herein referred to as the Terminator™ and New Zealand patent application No. 540097 describes a striker pin and drop-weight apparatus designed to be attached to an excavator or the like. The term gravity drop hammer is thus used herein to encompass powered drop hammers in addition to those powered solely by gravity.

In operation of the above-mentioned machines it is often desirable to move or lever rock and other material with the hammer or striker pin. Movement of the material can be achieved by placing the hammer or pin against the material and pushing or pulling with the excavator. However, with existing hammers the coupling between the hammer and excavator, known as the mounting plate, is a substantial distance from the striker pin so the pulling forces at the striker pin are low and difficult to control. This large separation between the striker pin and the mounting plate coupling with the excavator also increases the likelihood of generating high uncontrolled forces that can damage the hammer. Mounting the hammer at a distance from the striker pin thus causes time consuming, inaccurate and inconvenient operation of the hammer for the operator.

A rock breaking apparatus described in the applicant's New Zealand patent application No. 540097 can also perform levering and raking in addition to performing surface breaking tasks of conventional hammers.

Raking refers to using the excavator to pull surface rock horizontally along the ground using the side of the pin. The rock can be loose above the ground surface or be friable enough to be drawn towards the excavator after pressing or driving the point of the pin into the in-situ rock. When raking it is necessary for the hammer/arm assembly to remain locked relative to each other. The linkage geometry to maintain such a locked position requires far greater strength than conventional mounting methods, though ideally the linkage should still utilise standard components.

Levering is a particularly useful action of the rock breaking apparatus afore-mentioned. Levering refers to the driving of the point of the striker pin or hammer into non-friable in-situ rock creating or exploiting a crack. Once the crack is established, the operator can lever the hammer and pin through actuation of one end of the boom attached to the excavator and extract the rock from the ground or widen the cracks further. In such applications it is an important advantage to have the maximum torque and thus leverage available to pry intractable rocks.

Another advantage of being able to lever a powered hammer or breaking device is being able to apply the impact point at positions away from the top surfaces of the material to be broken. This is an important advantage of the applicant's previous inventions described in PCT application numbers PCT/NZ03/000235, PCT/NZ03/000236 and PCT/NZ03/000237. Often the rock requires fine manipulation to correctly position the hammer impact over a seam or weak point. In such scenarios, delivering high power in combination with fine control close to the striker pin provides a significant advantage.

Some existing earth working devices are capable of pivoting to allow the device to operate away from the vertical. Such a device is described in WO98/07952 by Persson. This device comprises pivotable links coupled to a drilling rig to pivot the rig by operation of a hydraulic ram. This allows the rig to be pivoted to drill at an angle away from the vertical. However, the device is unsuited for levering action due to the geometry of the linkage limiting the degree of applicable torque to unfeasibly low levels.

The theoretical maximum lifting capacity of an excavator is the moment resolved about the ends or sides of the tracks without tipping the excavator. The allowable lifting moment is a percentage of the tipping moment. However, not all this moment is available for lifting. The excavator arm and hammer assembly extending from the excavator apply a moment to the excavator which must be subtracted from the maximum lifting moment and is governed by;

a. the distance between the excavator and the drop hammer, b. the mass of the excavator arm and drop hammer, and c. any forces applied to the drop hammer or excavator arm.

Thus by minimising the counterproductive inherent tipping moment created by a)-b) above, the capacity of the excavator to resist any additional moments generated during levering and raking operations without tipping over is increased.

The impact energy of the drop hammer, divided by the mass of the excavator is herein defined as the power-to-weight ratio. A greater power-to-weight ratio implies either more breaking power for a given excavator size or a smaller excavator for a given breaking power. The profitability of a system is thus increased by a higher power-to-weight ratio.

Existing gravity drop hammers are attached to excavators via a wing and mounting plate arrangement attached to the excavator arm. These mounting plates must be custom made for each drop hammer and excavator to ensure the geometrical proportions of the plate are correct. The mounting plate and associated fixings on the drop hammer also add substantial weight to the drop hammer, thereby reducing the power-to-weight ratio and absorbing more moment capacity of any given excavator. The wing and mounting plate also increase the distance from the excavator to the centre of gravity of the drop hammer, which also reduces the power-to-weight ratio and absorbs more lifting moment capacity for a given excavator and arm extension.

In many regions globally, excavation, demolition and quarry operations are restricted from using explosives due to the elevated risks of explosives theft by unauthorized parties including rebels, terrorists and the like. Urban encroachment on quarries and mines has also made the use of explosives difficult and expensive in many regions due to community opposition to ground vibration. Obtaining the necessary permissions or consents from the relevant authorities to use explosives for laying roads, railways and pipelines has also become extremely difficult or impossible to achieve due to the above discussed factors. In such regions, it is thus desirable for a rock breaking machine to also be capable of levering embedded rocks, widening cracks, breaking rock faces and raking without the use of explosives.

It is thus desirable to provide a tool for a carrier such as an excavator, capable of striking a surface to be broken, hammered or compacted about a substantially linear axis and which is also capable of applying a torque and side load to an object substantially laterally to said axis to lever and rake rocks or other material.

It is also desirable to provide a tool that is readily attachable to standard excavator arms, enabling cost to be minimised by permitting different tools/implements to be fitted as required.

It is further desirable for the weight of the attachment mechanism of the tool and the distance between the implement and the excavator arm to be minimised.

It would be a yet further advantage for the implement to enable high forces to be applied about the levering pivot point when the implement is attached to an excavator, without damaging the tool or excavator.

There are many linkage systems and implements designed for attaching to earth working machines including those described in WO96/33315, WO90/03473, JP2000132448, JP2002145911, JP2001257017, JP05034057, JP09364906, JP63125843, JP11344858, DE19702624, EP0887475, EP1013835, EP0325358, EP0386904, EP0818581, U.S. Pat. No. 3,529,740, U.S. Pat. No. 3,743,126, U.S. Pat. No. 4,381,167, U.S. Pat. No. 4,486,141, U.S. Pat. No. 5,405,237, U.S. Pat. No. 5,609,464, U.S. Pat. No. 5,592,762, WO01/016433, WO02/22966, WO2004/016864, WO2004/027162 and WO2004/057114.

However, none of the devices described in these documents achieve the objectives of the present invention, i.e. to a) provide an implement for a rock working machine or excavator that is capable of striking a surface to be broken, hammered or compacted and that is also capable of pivoting so as to lever and rake rocks or other material.
b) minimise the weight of the attachment mechanism of the implement and/or the distance between the implement and the excavator.
c) provide a means of applying sufficient force to embedded rocks and the like to prise them from the ground by levering the tool about a pivot point when the tool is attached to an excavator.
d) provide fine control of the forces in the striker pin.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a hammer assembly for breaking, levering and raking material, said hammer assembly including:

an impact hammer including:
- a movable mass capable of linear reciprocating movement for impact along an impact axis,
- an elongated tool received within the hammer assembly, said tool having a longitudinal axis substantially parallel or coaxial with said impact axis, said tool having two opposed ends with one end projecting from the hammer assembly to form an operative tool head for use during said levering and/or raking operations;
- a primary pivot attachment point adapted for attaching the hammer to a distal end of an operating arm attached to the carrier for pivotal movement of the hammer about a primary axis orthogonal to said impact axis;

an articulated control linkage including first and second links for effecting said pivotal movement of the hammer about said primary axis in response to movement from a drive attached to said operating arm,
- said first link being pivotally attachable:
  - to said hammer at a first end to form a secondary pivot axis parallel to said primary axis,
  - at a second end to said drive forming a tertiary pivot point axis and
  - to said second link,
- said second link being pivotally attachable
  - at a first end to the operating arm forming a quaternary pivot axis parallel to said secondary and tertiary axes,
  - at a second end to said second end of said first link and
  - at a second end to said drive, characterised in that said primary, tertiary and quaternary pivot axes are all located on an opposing side of said impact axis to said secondary pivot axis, and said first link includes a pair of arms, spaced apart to receive the hammer therebetween Preferably, said primary pivot axis is located laterally to said impact axis between said opposed distal ends of the tool.

Preferably the hammer assembly includes a hammer of the type described in PCT application numbers PCT/NZ03/000235, PCT/NZ03/000236, PCT/NZ03/000237, New Zealand Patent Application No. 540097 or U.S. Pat. No. 4,383,363 (incorporated herein by reference). However, it should be appreciated that the present invention is equally suited to other powered hammer mechanisms, gravity drop hammers or the like.

In one embodiment, the tool and movable mass are formed as a single item. In such embodiments, the movable mass performs breaking operations by travelling along said impact axis (under assistance or by gravity alone) until one end projects from a hammer housing to strike the target surface. However, such hammer configurations are not usable for levering or raking operations unless the movable mass tool is secured relative to the hammer housing by a tool lock. Locking the tool rigidly to the hammer housing/assembly prevents the tool being forced back inside the hammer assembly during raking or levering operations. Thus, in a further embodiment, the hammer assembly further includes a tool lock capable of rigidly fixing the tool to the hammer assembly with one end of said tool projecting from the hammer assembly to form said striker pin for use during raking and levering operations.

In alternative embodiments, the hammer is formed with a separate moveable mass and a tool (known as a 'striker pin') coupled to the hammer. During breaking operations, the tip of the striker pin projecting from the hammer is placed in contact with the target surface and the mass is propelled (again either by gravity or under assistance) to strike the opposing end of the striker pin which transfers the impact via the external striker pin tip to the target surface. It will be appreciated the tool may be coupled to the hammer assembly in a variety of configurations, which allow the impact from the movable mass to be transferred directly to the work surface without impacting a high shock load to the hammer housing and carrier. Thus, slideable couplings are required to allow a degree of tool travel along the impact axis, whilst retaining the striker pin from falling out completely of the hammer assembly. In a preferred embodiment, the slideable coupling includes at least one retaining pin engagable with a corresponding projection or indentation to define limits of allowable travel of the striker pin along the impact axis. Alternatively, the coupling may be formed by a resilient mounting, or biasing means such as an elastomeric coupling or spring, buffer or the like.

Thus, as used herein, the term 'tool' is defined as including a striker pin coupled to the hammer assembly and a movable mass used directly for breaking operations capable of being locked to the hammer assembly by a tool lock for raking and levering operations.

Throughout the specification, reference is made to the hammer being attached to an arm of a carrier in the form of an 'excavator arm'. However, this should not be seen to be limiting as the hammer may be attached to any suitable machine including other demolition, quarrying or rock working machines.

Preferably said first link includes a pair of arms spaced apart to receive the hammer therebetween. The use of two (preferably symmetrically configured) arms increases the strength and structural integrity of the first link. Although the use of a single arm may be implemented, such a configuration places limitations on the torque that may be applied during levering actions without twisting and bending the single arm about the arm's longitudinal axis. In alternative embodiments said first link may include a pair of jaws or other encircling members pivotally coupled to the hammer. Configuring the hammer attachment to the carrier arm to allow the hammer to effectively pass 'through' the attachment, rather than attaching to the side or end of the hammer, provides significant control and strength advantages.

It can be seen that in an alternative embodiment, said quaternary pivot axis may be coaxial with said primary pivot axis. However, typical excavator arms are configured with the primary pivot point at a distal end of the arm with the quaternary pivot point and second link located at an intermediate position between the primary pivot point and the drive.

In one embodiment, a drive in the form of a hydraulic ram is used to provide force to the first and second links to pivot the hammer about said primary axis. However it should be appreciated that other mechanisms may be used such as pneumatic rams, or any other form of drive or drives, capable of extending a rod or arm, either directly or indirectly via supplementary linkages. A pair of drives may be used for example, placed symmetrically on opposing lateral sides of the carrier arm and individually acting on corresponding control linkages passing either side of the hammer. Herein reference will be made to the operation of a hydraulic ram and actuator mechanism as used in preferred embodiments of the present invention, though this is exemplary only and should not be seen to be limiting in any way.

Upon extension of the drive, the first and second links pivot at their first ends about the secondary and quaternary pivot axes respectively. Both links also pivot at their common connection to the drive about the tertiary pivot axis. The angle subtended between the first and second links at the tertiary pivot point on the opposing side to the drive increases as the drive extends thus forcing the tertiary pivot axis away from the carrier operating arm. This applies a torque to the hammer about the primary pivot axis causing the hammer to pivot about same, moving the hammer tip towards the carrier.

Preferably the first link is pivotally coupled to the outermost edge of the hammer relative to the excavator arm, thereby maximising the distance (herein referred to as 'torque distance') between the primary pivot and secondary pivot axes. The torque applied to the implement for a force of given magnitude is dependant on the direction of the force applied by the hydraulic ram via the first link and the 'torque distance'. The greatest torque for a given force and torque distance is achieved when the direction of the applied force (i.e. the angle of the first link) is orthogonal to the axis of the torque distance. Maximising the torque of the present invention is one key aspect of ensuring maximum productivity and effectiveness.

The present invention also relies on the specific location of the primary pivot axis with respect to the tool head tip. It is desirable to locate the primary pivot axis as close as practicable to the tool head tip, to maximise levering and raking ability. Prior art attachment of hammers place the primary pivot axis at some distance from the tool head as levering and raking operations fall outside their intended usage. In the present invention, the attachment point for the primary pivot axis is deliberately configured to lie close to the tool head tip. It has been found that for effective levering and raking operation, the primary pivot point is located in a region between the tool head and a line subtended orthogonally from the impact axis from the end of the tool distal to the tool face. In embodiments with a fixed tool in the form of a striker pin coupled to the hammer assembly, this distance is typically very close to the nose block of the hammer.

In embodiments using a tool lock to lock the movable mass, the opposing end of the tool to the tool head is typically further separated than that of a striker pin configuration. However, it still provides a readily definable cut-off, beyond which placement of the primary axis pivot point provides no worthwhile levering or raking effectiveness.

Another advantage of coupling the first link to the furthermost side of the implement is that it maximises the range of angle through which the implement may rotate about the main pivot and thus maximises the range of levering ability.

In preferred embodiments the length of the first and/or second links is adjustable. Therefore, the length of the links can be extended or reduced to respectively accommodate a larger or smaller implement. Also, by increasing the length of a link, the maximum achievable angle of rotation of the implement about the main pivot is also increased.

In one embodiment, the length of the first and/or second links is adjustable, preferably by providing at least one locking mechanism to lock the length of the link for any given incremental change in length.

In preferred embodiments each arm of the first link is formed from two or more joined segments. Preferably each arm is formed from first and second segments each having a plurality of apertures incrementally spaced apart on a longitudinal axis for receipt of one or more bolts, lugs, pins, rivets or the like.

In one embodiment for example, the two segments may be joined by lining up two pairs of apertures on each of the first and second segments. A bolt is passed through at least one of the apertures and nuts screwed onto the bolts and tightened. The two segments are thus joined together and locked in place. Bolts can be applied to any number of apertures to increase the strength of the attachment. The length of the first link may be varied by aligning different apertures and joining the two segments.

Preferably the control linkage includes a tie member bridging the arms of the first link. The tie member maintains the arms parallel and minimizes any tendency of the hammer to rotate or pivot about the longitudinal axis of the first link, thereby twisting the first link and potentially damaging same. Preferably the tie member is substantially rigid and is attached to each arm of the first link.

In preferred embodiments the linkage on the excavator arm will be provided with a first and/or second link of adjustable length.

A further important requirement for the effective levering and raking of material is the application of an even torque and power during the operational range of rotation of the hammer about the primary axis. A consistent power delivery is affected by the angle between the control linkages though the range of rotation of the hammer. In a preferred embodiment, said first and second link subtend an angle between 60-150° at the tertiary pivot axis on the opposing side to said drive during rotation of the hammer about the primary axis.

It will be appreciated the present invention may be considered to reside in both a hammer substantially as hereinbefore described attachable to a carrier and control linkage for attaching known hammers to a carrier and a method of attaching same.

Thus, according to a further aspect, the present invention includes a control linkage attachable to a carrier and an impact hammer for breaking, levering and raking material, said hammer including:

- a movable mass capable of linear reciprocating movement for impact along an impact axis,
- an elongate tool received within a hammer assembly having a longitudinal axis substantially parallel or coaxial with said impact axis, said tool having two opposed ends with one end projecting from the hammer assembly to form an operative tool head for use during said levering and/or raking operations;
- a primary pivot attachment point adapted for attaching the hammer to a distal end of an operating arm attached to the carrier for pivotal movement of the hammer about a primary axis orthogonal to said impact axis, wherein said primary axis is located laterally to said impact axis between said opposed distal ends of the tool;

characterised in that said control linkage includes a first link for effecting said pivotal movement of the hammer about said primary axis in response to movement from a drive attached to said operating arm, said first link being pivotally attachable:

- to said hammer at a first end to form a secondary pivot axis parallel to said primary axis,
- at a second end to said drive forming a tertiary pivot point axis, and
- to a second link, pivotally attached at
  - a first end to the operating arm forming a quaternary pivot point axis parallel to said secondary and tertiary axes, and
  - at a second end to said drive wherein said first link is attachable at said second end to said second end of said second link such that said primary, tertiary and quaternary pivot axes are all located on an opposing side of said impact axis to said secondary pivot axis and said first link includes a pair of arms, spaced apart to receive the hammer therebetween.

Thus, by the simple replacement of the conventional first link of an existing control linkage with a replacement first link of the present invention, a suitable impact hammer may be operated in the advantageous raking and levering manner described herein.

Thus, the hammer can be attached to existing excavators with minimal adaptation of the excavator resulting in significant cost savings by replacing the need for multiple excavators with a single excavator with interchangeable implements. The costly, time consuming and problematic fitment of existing drop hammers to excavators via a customised wing and mounting plate fitment, configured to fit both the existing first and second links of the excavator arm is thus also circumvented.

According to a further aspect, the present invention includes a carrier having an articulated operating arm attached to a hammer assembly for breaking material, said hammer assembly including:

- an impact hammer including:
  - a movable mass capable of linear reciprocating movement for impact along an impact axis,
  - an elongate tool received within the hammer assembly having a longitudinal axis substantially parallel or coaxial with said impact axis, said tool having two opposed ends with one end projecting from the hammer assembly to form an operative tool head for use during said levering and/or raking operations;
  - a primary pivotal attachment point attached to the hammer to a distal end of the operating arm for pivotal movement of the hammer about a primary axis orthogonal to said impact axis;
- an articulated control linkage including first and second links for effecting said pivotal movement of the hammer about said primary axis in response to movement from a drive attached to said operating arm,
  - said first link being pivotally attached to the hammer at a first end to form a secondary pivot axis parallel to said primary axis, said first link being pivotally attached at a second end to both said second link and to said drive forming a tertiary pivot point axis,
  - said second link also being pivotally attached at a first end to the operating arm forming a quaternary pivot point axis parallel to said secondary and tertiary axes, said second link being pivotally attached at a second end to said second end of said first link and to said drive at said tertiary pivot point, characterised in that said primary, tertiary and quaternary pivot axes are all located on an opposing side of said impact axis to said secondary pivot axis; and said first link includes a pair of arms, spaced apart to receive the hammer therebetween.

Preferably, said primary pivot axis is located laterally to said impact axis between said opposed distal ends of the tool.

According to a further aspect of the present invention, there is provided a method of attaching a hammer assembly substantially as hereinbefore described to a carrier arm, said method including the steps of;

decoupling any existing attachments coupled to said arm by said primary pivot point and an existing control linkage, removing any existing first linkage, pivotally coupling the impact hammer to the carrier at the primary pivot point, pivotally attaching a new first linkage extending between the secondary and tertiary pivot axes.

The replacement first link may be of a fixed size, dimensioned for attachment between a known carrier arm linkage configurations. Alternatively, the first link may be of adjustable length enabling a given impact hammer to be readily fitted to a range of carrier arms of differing geometries.

Minimising the lateral separation of the hammer and the carrier arm provides the further benefit of reducing the counterproductive inherent tipping moment created by the attached hammer before any additional moments are generated during levering and raking operations. Thus, according to one embodiment, the separation of the primary pivot axis orthogonally from the impact axis is less than the overall length of said tool.

Therefore, it can be seen that the present invention offers significant advantages over the prior art including;

a. An enhanced levering and raking ability, achieved by maximising both the range of rotation and torque about the main pivot.

b. An implement readily attachable to typical excavator arms such as those designed for bucket attachments.

c. An efficient installation process, achieved by providing one or more links of adjustable length.

d. A high power-to-weight ratio and lifting capacity, achieved by minimising the weight of the implement—excavator arm attachment mechanism.

BRIEF DESCRIPTION OF DRAWINGS

Further aspects and advantages of the present invention will become apparent from the following description which is given by way of example only and with reference to the accompanying drawings in which.

BEST MODES FOR CARRYING OUT THE INVENTION

Figure 1:
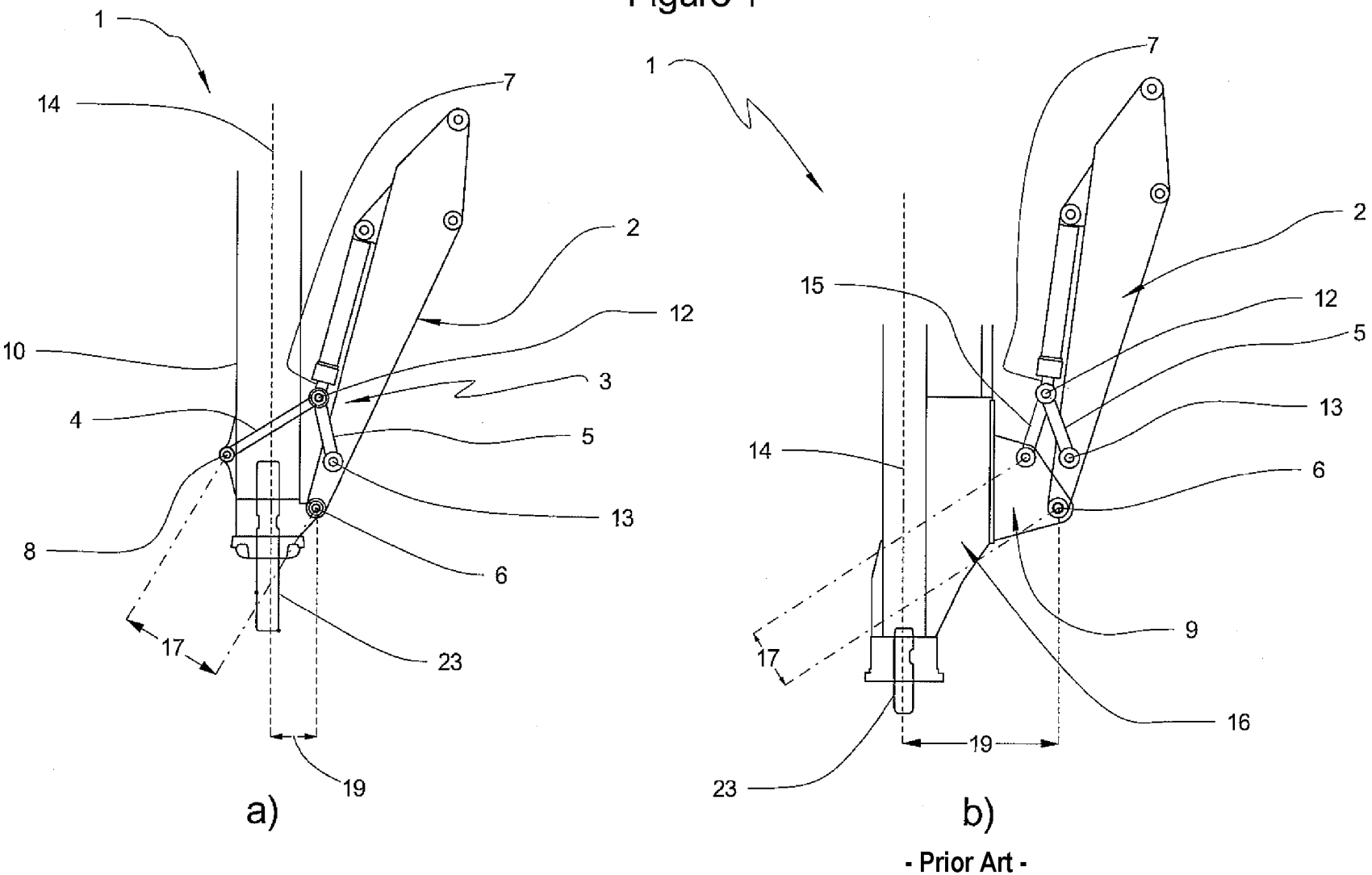
FIG. 1*a*) shows a preferred embodiment of the present invention in the form of a hammer assembly attached to a carrier arm.
FIG. 1*b*) shows a prior art impact hammer attached to a carrier arm.
FIG. 1*c*) shows a cross section through XX shown in FIG. 1*a*)
FIG. 1*d*) shows a further embodiment with an alternative control linkage arrangement to that shown in the embodiment illustrated in FIG. 1*c*)

FIGS. 1-5 show preferred embodiments of the present invention including a hammer assembly with means of attaching an impact hammer in the form of a gravity drop hammer (1) attached to a carrier arm (2) of a carrier (not shown) such as an excavator. The embodiment shown in FIGS. 1*a*) and 1*d*) shows a novel means of attaching the hammer (1) to the carrier arm (2) (both of known type) via an articulated control linkage (3) comprising a first (4) and second (5) link to provide additional functionality over prior art attachment configurations such as shown in FIG. 1*b*). The hammer (1) and linkage (3) collectively form the hammer assembly. It will be understood both the hammer (1) and excavator carrier arm (2) shown are used for exemplary purposes only and the invention is not limited to same.

The present invention is primarily adapted for use with impact hammers (1) such as gravity drop hammers, powered drop hammers, hydraulic hammers and the like. Although specific implementations of such designs differ, each generally includes some form of movable mass located within a hammer housing (10) and capable of linear reciprocating movement along an impact axis (14). The hammer (1) includes an elongate tool received within the hammer assembly and has two opposed ends and a longitudinal axis coaxial with the impact axis (14). One end of the tool projects from the hammer assembly, to form an operative tool head for use during said levering and/or raking operations. Depending on the construction of the hammer (1), the tool may take different forms. In one embodiment, the movable mass and the tool may be formed as a single element which is locked from movement to the hammer (1) during levering and raking with one end of the tool projecting from the hammer (1) to form the tool head. It will be appreciated however that in such embodiments (not shown), a hammer tool lock (as described in the inventors international application PCT/NZ03/000236 incorporated herein by reference) is required to fix the tool relative to the hammer housing (10) during raking and levering operations.

Figure 1C:
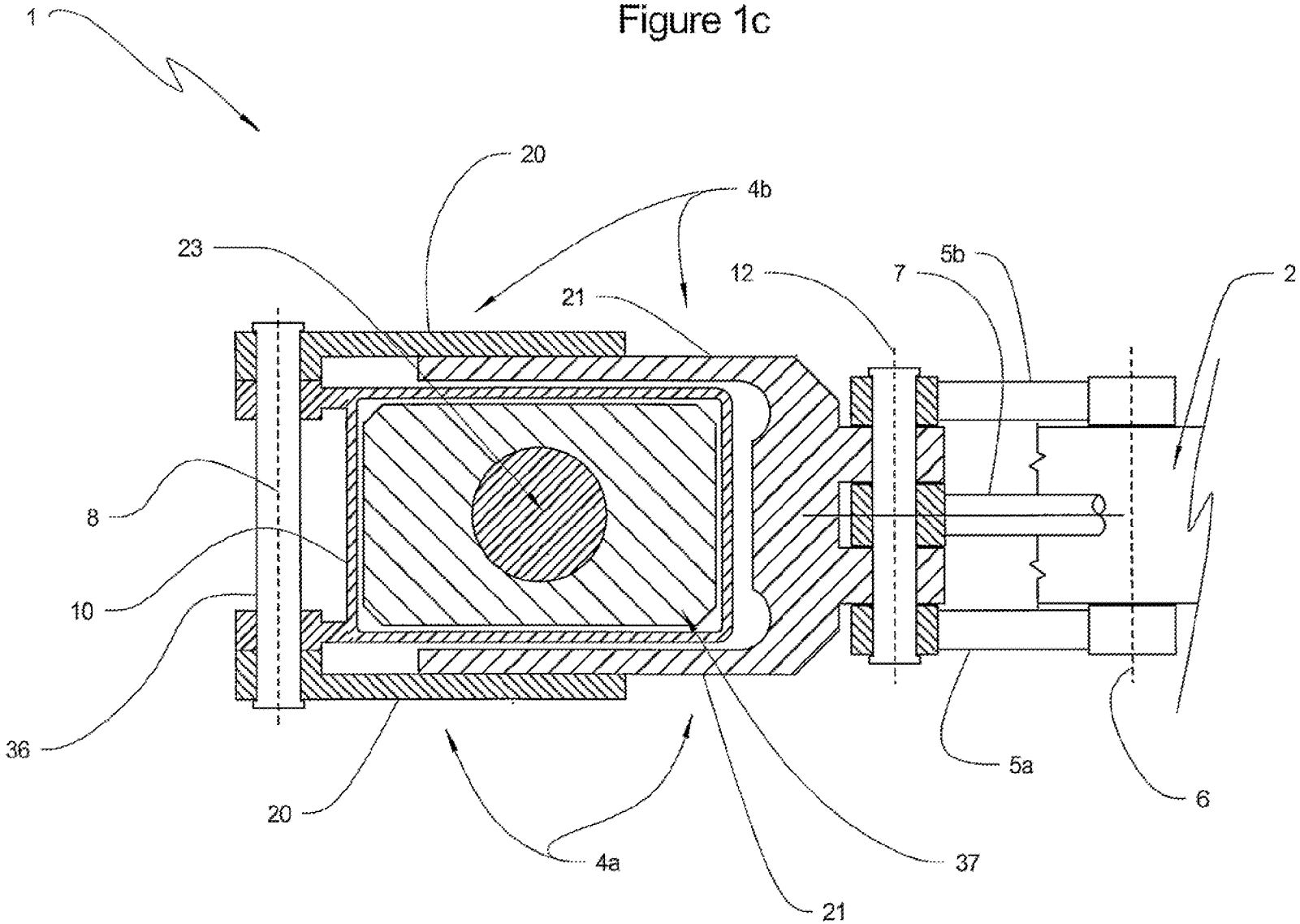

In an alternative embodiment (as shown in FIGS. 1*a-c*)), the tool is an element coupled to the hammer (1) at the lower end of the hammer (1). The coupling may take several forms capable of preventing vibration/shock transfer between the striker pin (23) and the hammer (1) during impacts from the moveable mass. Thus, the coupling is configured to allow the striker pin (23) a degree of free travel relative to the hammer (1) within defined limits. In the preferred embodiment shown in FIG. 1*a*, the striker pin (23) is configured with one end projecting from the hammer (1) to form the tool head. The striker pin (23) is slidably coupled to the hammer (23) to allow free movement along (or substantially parallel to) the impact axis between limits defined by a pair of retaining pins (not shown) engaging within longitudinal slots in the striker pin (23). Such a coupling configuration is described in greater detail in the applicant's co-pending Patent application NZ Pat App No. 540097, (incorporated herein be reference) and PCT/NZ0093/00074 and dependant patents.

Thus, depending on the construction of the hammer (1), the tool may be formed as a moveable weight and locked from movement during levering and raking; or, the tool is formed as a separate element (i.e. the striker pin (23)) distinct from the movable weight The hammer assembly in FIG. 1*a*) differs from prior art impact hammer attachments in its capability to apply significant torque levels to a work surface by movement of the striker pin (23) laterally to said impact axis (14) for levering and raking.

The hammer (1) is attached to the carrier arm (2) at a primary pivotal attachment point (6) attached to the hammer (1) at a distal end of the operating arm (2) for pivotal movement about a primary pivot axis (6) orthogonal to said impact axis (14).

The articulated control linkage (3) provides a means for effecting pivotal movement of the hammer (1) about said primary axis (6) in response to movement from a drive in the form of a hydraulic ram (7) attached to said operating arm (2).

The first link (4) is pivotally attached to the hammer (1) at a first end to form a secondary pivot axis (8) parallel to said primary axis (6), said first link (4) also being pivotally attached at a second end to said second link (5) forming a tertiary pivot axis (12).

The second link (5) is pivotally attached at a first end to form a quaternary pivot point axis (13) on the carrier operating arm (2), said quaternary pivot axis (13) being parallel to said secondary (8) and tertiary (12) axes, said second link (5) also being pivotally attached at a second end to said second end of the first link (4) at said tertiary pivot axis (12) and to said drive (7), preferably coaxial with said tertiary pivot point axis (12).

The first link (4) is comprised of a pair of arms (4*a*, 4*b*) passing either side of the hammer (1) as shown in FIG. 1*c*). Encircling the hammer (1) in this manner provides a robust configuration capable of withstanding the high loads imposed during levering and raking operations whilst also reducing the tipping moment of the excavator. A tie (36) extending along the secondary pivot axis (8) between the arms (4*a*, 4*b*) provides further structural integrity to the control linkages. It will be appreciated that in an alternative embodiment (not shown), a pair of drives (7), on opposed lateral sides of the arm (2), may be used to act on the individual arms (4*a*, 4*b*) on opposing sides of the hammer (1).

In FIG. 1*c*), it can be seen the pair of arms (4*a*, 4*b*) of the first link (4) are configured to be of adjustable length. As discussed further with reference to FIG. 1*b*) the arms (4*a*, 4*b*) are each formed from two overlapping segments (20, 21) releasably secured together by any suitable known method, e.g. bolts, pins and the like.

Figure 1D:
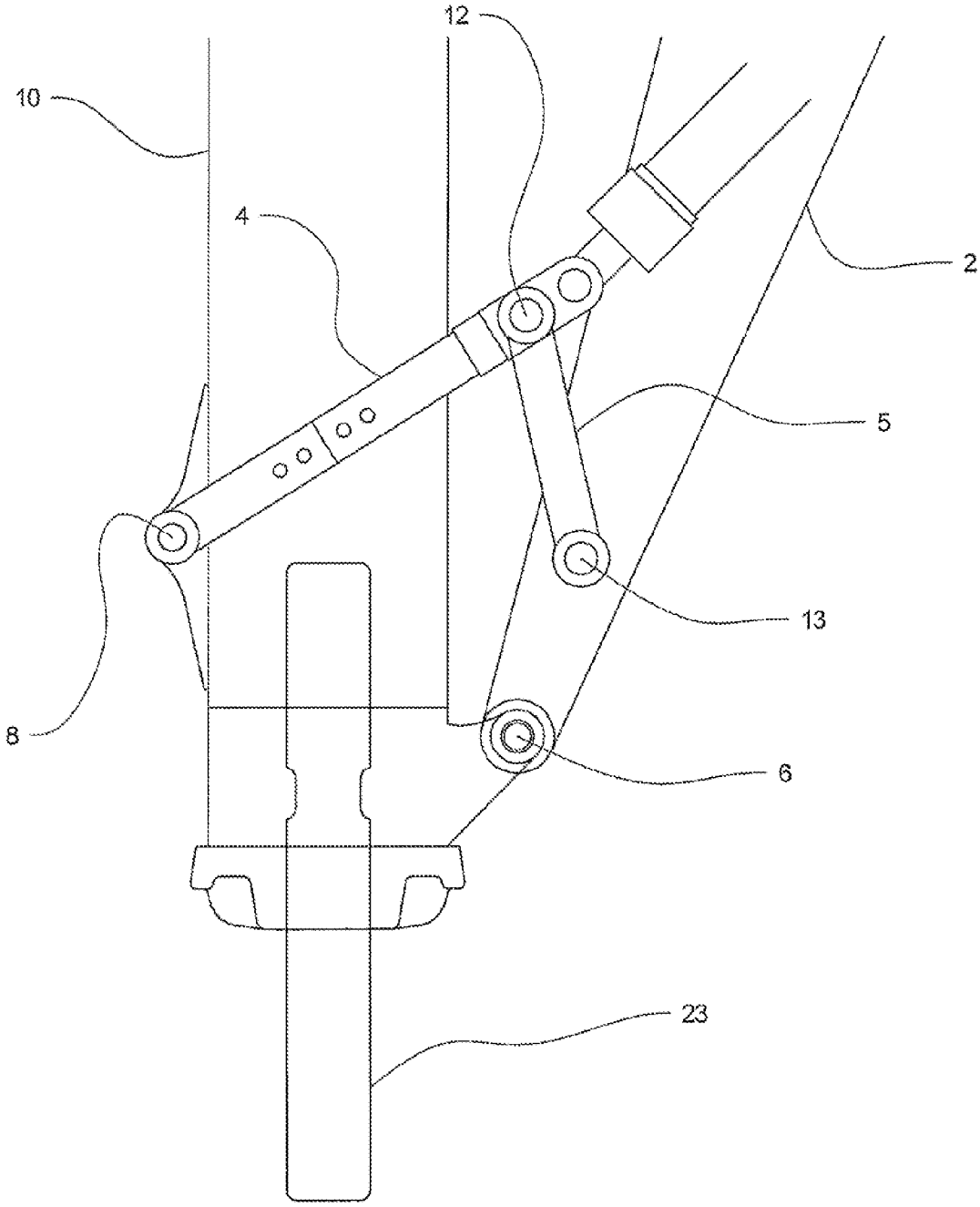

In an alternative embodiment shown in FIG. 1*d*), the drive (7) may be attached to the first link (4) eccentrically from the tertiary axis (12) at a further quinary pivot axis point (24).

The present invention differs from the prior art (as shown in FIG. 1*b*)) in that the primary pivot point axis (6) is located laterally to said impact axis (14) between the opposed distal ends of the striker pin (23) and said primary, tertiary and quaternary pivot axes (6, 12, & 13) are all located on an opposing side of said impact axis (14) to said secondary pivot axis (8). This enables significantly higher levering forces/torque to be applied by the striker pin (23) by increasing the separation (referred to herein as the 'torque distance' (17)) between the primary pivot axis point (6) and the secondary pivot axis (8) whilst minimizing the distance (35)) from the striker tip (31) to the primary pivot axis (6). Moreover, the geometry of the control linkage (3) enables a higher degree of levering power to be applied evenly throughout the full stroke of the drive (7) pivoting the hammer (1) about the primary axis (6).

In operation; extension or retraction of the hydraulic ram (7) acts to pivot the first and second links (4, 5) in opposing directions about the secondary pivot axis (8) and quaternary pivot axis (13) respectively. Both links also pivot in opposite directions about the tertiary pivot axis (12). As the ram (7) extends, the first and second links (4, 5) are splayed apart at the tertiary pivot axis (12) and thus the angle subtended therebetween is increased whilst the secondary pivot axis (8) is pushed out away from the carrier arm (4). The force from the drive (7) acting along the first link (4) applies a torque to the hammer (1) at the secondary pivot axis (8), causing the hammer (1) to pivot about the primary pivot axis (6) towards the carrier.

Thus, the hammer (1) may not only be operated to break rock, concrete or other material by percussion impacts of the striker pin (23) along the impact axis (14), but also to rake or lever material by a pivoting and locking action about the primary pivot axis (6). Such actions may also be employed by prior art methods of attaching a hammer (1) to an excavator arm (2), though the prior art configurations used pose several shortcomings. FIG. 1*b* shows a typical hammer (1) and prior art attachment method. A wing (16) and mounting plate (9) are used to attach the hammer (1) to the carrier arm (2). The mounting plate (9) is pivotally attached at the secondary pivot axis (8) to the first link (4), and to the carrier arm (2) at the primary pivot axis (6). In contrast to the present invention, the mounting plate (9) is configured to be coupled directly to the existing links (4, 5) used to attach a bucket or the like and consequently the separation (or 'torque distance (17)) between the primary pivot axis (6) and the secondary pivot axis (8) is significantly reduced.

Moreover, in the prior art, the hammer (1) body is mounted further outboard from the arm (2) further increasing the position of the center of gravity of the hammer (1) and arm (2) assembly away from the carrier body (not shown), thereby increasing the tipping moment of the excavator and thus decreasing the ability to lever and rake material. This is contrasted in FIGS. 1*a*) and *b*) which show the increased distance (19) from the carrier arm (2) to the impact axis (14) of the hammer (1) of the prior art in FIG. 1*b*, compared to the present invention in FIG. 1*a*). The increased moment of the carrier about the base (not shown) of the carrier arm (2) in the prior art configuration for any given arm extension reduces the moment available for raking and levering operations without exceeding the tipping, limit of the carrier. This is accentuated at the maximum extension of the carrier arm (2). The slight increase in reach caused by the mounting plate (9) and wing (16) is of minimal benefit as impact hammers (1) are now overwhelmingly mounted on excavators which possess ample reach. In the preferred embodiments shown, the separation (19) of the primary pivot axis (6) orthogonally from the impact axis (14) is less than the overall length of the striker pin (23). It has been found raking and levering operations are ineffective for greater separation distances (19).

The relatively small attachment base of the wing (16) to the mounting plate (9) (resultant from the smaller torque distance (17)) and the increased separation (16) requires the wing (16) and mounting plate (9) to be made sufficiently robust to support the hammer (1) in operation without deformation and thus adding substantial weight to the hammer (1) and carrier (2) arm assembly. This increase in weight reduces the power-to-weight ratio of the hammer and carrier.

Figure 2:
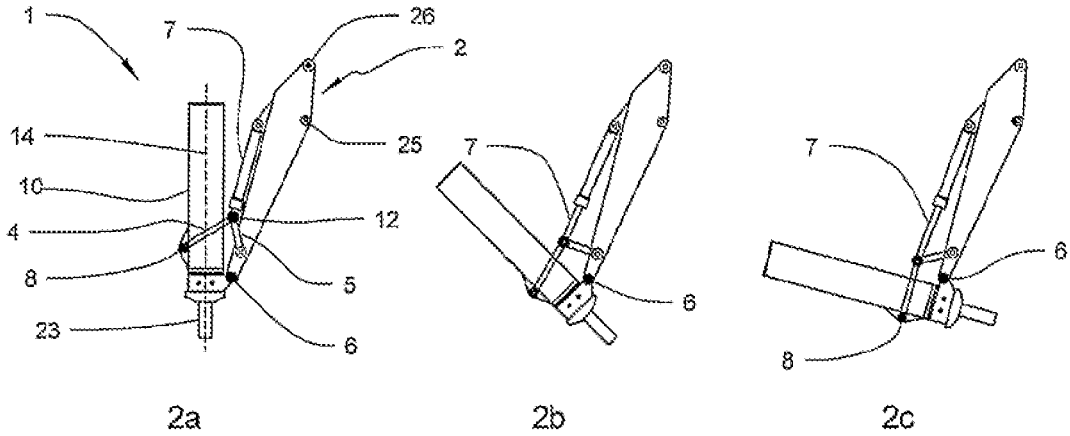
FIG. 2*a-c*) shows side elevations of a preferred embodiment of the present invention shown in FIG. 1*a*) through the range of motion of the impact hammer about the primary axis, with the secondary pivot axis located on outermost side of the hammer relative to the primary, tertiary and quaternary axes.
Figure 3:
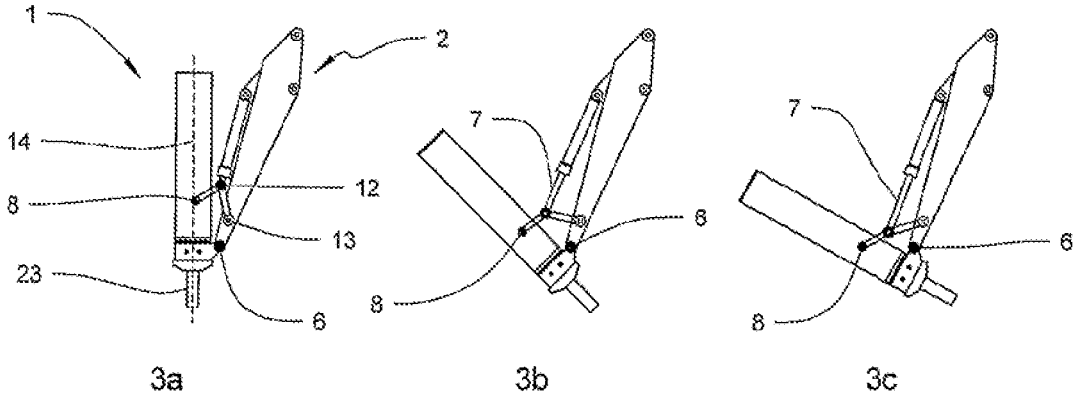
FIG. 3*a-c*) shows side elevations of a preferred embodiment of the present invention through the range of motion of the impact hammer about the primary axis, with the secondary pivot axis located on the impact axis of the impact hammer.
Figure 4:
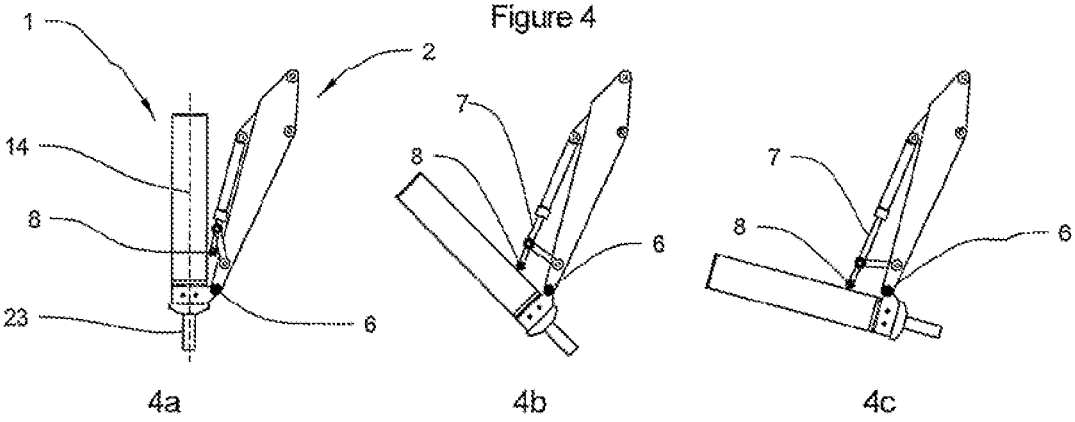
FIG. 4*a-c*) shows side elevations of a prior art embodiment through the range of motion of the impact hammer about the primary axis, with the secondary pivot axis located the adjacent side of the hammer relative to the carrier arm.

It will be appreciated that levering performance advantages are obtained by moving the secondary pivot axis (8) further outboard away from the primary pivot axis (6). However, it will also be seen that there is a significant trade-off in performance in some configurations for different portions of the pivotable range of the hammer (1). FIGS. 2-4 show the range of motion of the hammer (1), about the primary pivot axis (6) when the position of the secondary pivot axis (8), is moved successively outboard from the carrier arm (2).

Figure 5:
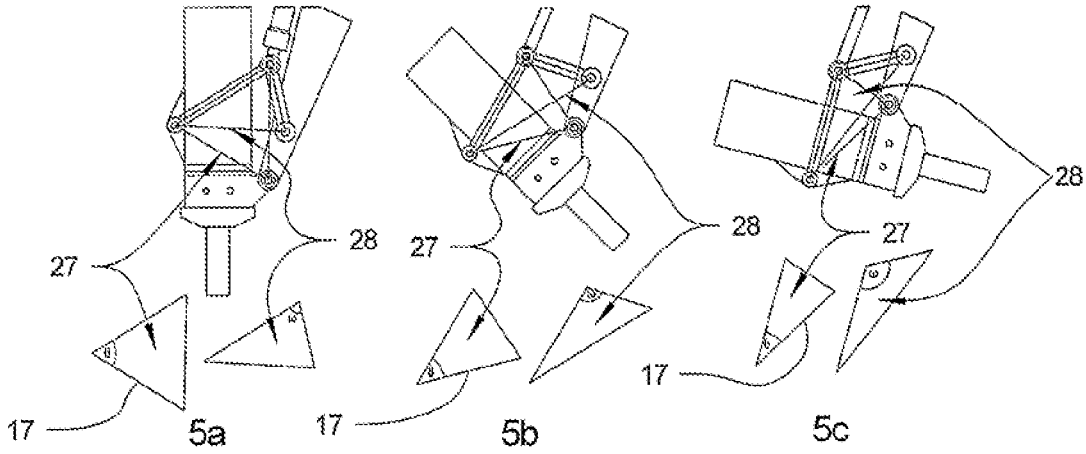
FIG. 5*a-c*) shows an enlarged view of the control linkage shown in FIG. 3*a-c*)
Figure 6:
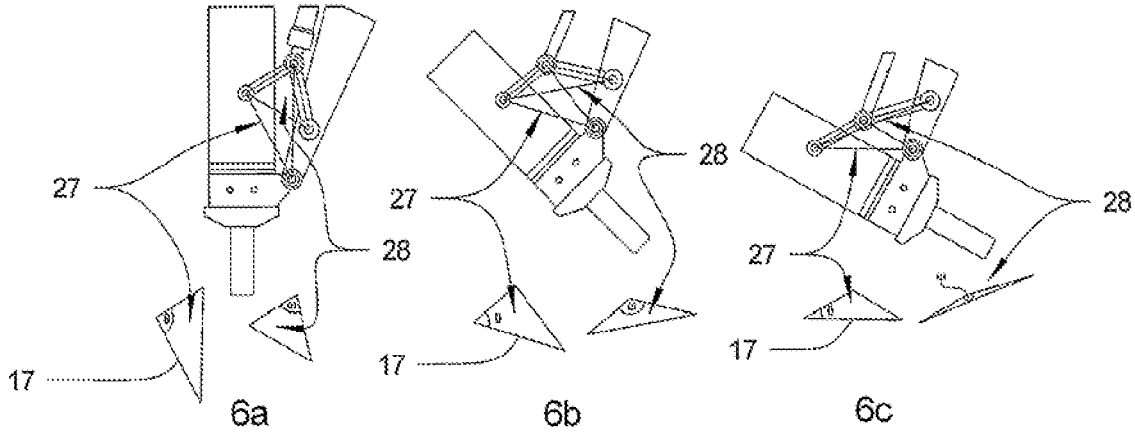
FIG. 6*a-c*) shows an enlarged view of the control linkage shown in FIG. 4*a-c*)
Figure 7:
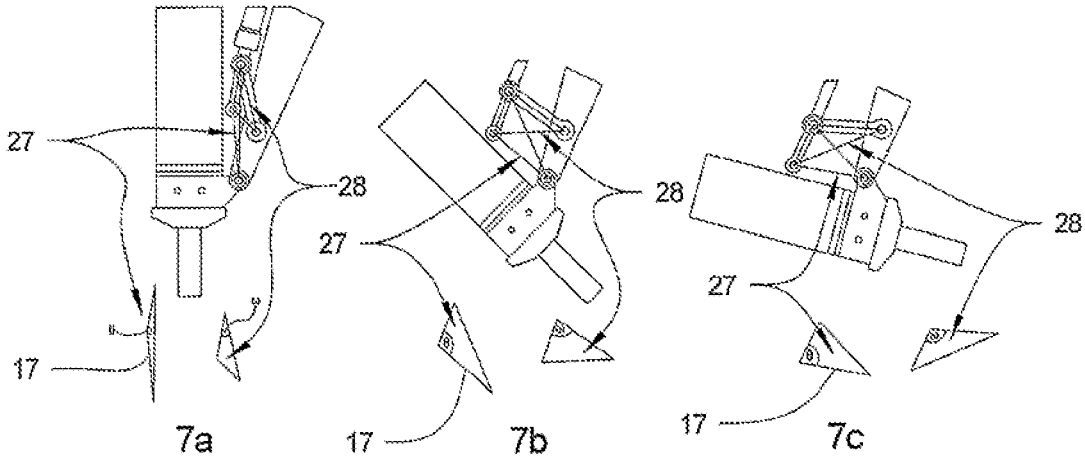
FIG. 7*a-c*) shows an enlarged view of the control linkage shown in FIG. 5*a-c*)

In more detail, FIGS. 2*a-c*) show the secondary pivot point (8) located on the opposing side of the hammer (1) to the carrier arm (2), at the laterally outermost position from the impact axis (14). FIG. 3*a-c*) shows the secondary pivot point (8) positioned on the impact axis (14), while FIGS. 4*a-c*) show an embodiment with the secondary pivot axis positioned on the same side as the carrier arm (2) as per the prior art. FIGS. 5-7 show enlarged portions of the control linkages assemblies (3) and adjacent portions of the hammer (1) corresponding to FIGS. 2-4.

In each of FIGS. 2-7, the series of illustrations a)-c) show the effects of increased extension of the drive (7) causing the striker pin (23) to rotate anticlockwise towards the carrier (not shown).

It will be seen that the greatest torque distance (17) is present in the embodiment in FIG. 2, whilst the prior art configuration in FIG. 4 has the smallest torque distance (17) and the embodiment of FIG. 3 possessing an intermediate value.

It will also be seen that despite a comparable range of movement for the hammer (1) about the primary axis (6) for the embodiments of FIGS. 2 and 4, the intermediate configuration shown in FIG. 3 has a restricted range. FIG. 3*c*) shows the hammer (1) rotated to it's furthest practical extent without potential destructive forces being applied to the hammer (1) by the configuration of the control linkages (3).

The range of movement in the series a)-c) in FIGS. 2-7 represents the articulation of the hammer (1) about the primary axis (6) from a start point (FIG. 2*a*), 3*a*, 4*a*)) with the impact axis (14) orientated vertically and the carrier arm (2) proximal to the carrier for maximum levering force. However, it will be appreciated that the carrier arm (2) is typically mounted on a further articulated arm (not shown) or in some other manner configured for rotation about the pivot point (25) via a further ram drive (not shown) attached to the tip of the carrier arm (2) at pivot point (26). Thus, the hammer (1) and carrier arm assembly (1, 2) may be raised for use on an elevated rock face or the like, whereby the hammer (1) shown in 2*b*)-*c*), 3*b*)-*c*) and 4*b*)-*c*) are operating with the impact axis (14) substantially upright. It is thus still important to be able to apply high levering levels at such orientations. It is also important that the power delivered to the hammer (1) for levering is substantially uniform throughout the pivotal range about the primary axis (6).

FIGS. 5-7 show in greater detail the geometry of the first and second linkages (4, 5) for the embodiments shown in FIGS. 2-4 through the actual rotation ranges in illustrations a)-c). Moreover, the geometric relationships between the positions of the primary, secondary and tertiary pivot axes (6, 8, 12) and between the secondary, tertiary and quaternary pivot axes (8, 12, 13) are depicted by the 'torque' and 'power' triangular relationships (27, 28) respectively shown adjacent the respective illustrations 5*a*)-7*c*).

In the torque triangle (27), it will be readily apparent that the torque applied to the primary pivot axis (6) by force acting on secondary pivot point (8) via the first link (4) is optimised when:

The angle θ subtended at the secondary pivot point (8) between the first link (4) and a line between the primary (6) and secondary (8) pivot axes, (i.e. the torque distance (17)) is 90°, and when the torque distance (17) is a maximum.

It will be seen that in the preferred embodiment in FIG. 5*a*)-*c*) although the angle θ is not 90° at any point, it is still relatively close and moreover, varies little during the rotation in the stages a)-c). Combined with a highest torque distance value (17) of the three embodiments shown in FIGS. 5-7, is will be seen the preferred embodiment (FIG. 5*a*)-*c*)) is capable of applying the highest average torque throughout the full range of movement about the primary pivot axis (6).

In contrast, compared to the embodiment of FIG. 5, the embodiments of FIGS. 6 and 7 both possess drawbacks of either an undesirable value of 0 (see FIGS. 6*c*) and 7*a*)) and/or a small torque distance (17). (FIGS. 7*a*)-*c*)).

Moreover, the effective power delivered by the drive (7) to provide leverage with the striker pin (23) is a function of the rate of movement of the drive (7) compared to the rate of movement of the striker pin (23). This is governed by the angle ω formed by the control linkage (3) at the tertiary pivot (8) where optimum values of ω are over approximately 70°. Assuming the use of a drive (7) with the same power in the embodiments in FIGS. 5-7, it can be seen that acute ω angles less than approximately 70° deliver low power (particularly that in FIG. 7*a*), whilst in FIGS. 7*b*)-*c*) for the same embodiment, high power is being delivered as the angle ω increases between approximately 70-110°. Given the hammer (1) orientation in 5*a*), 6*a*), 7*a*) is of primary importance in most levering situations where a rock is being pried from the ground, low power delivery is undesirably low.

Again, it will be seen that in contrast, the preferred embodiment in FIGS. 5*a*)-*c*) displays an angle ω of between 70-150° throughout the rotation about the primary axis (6).

Figure 8:
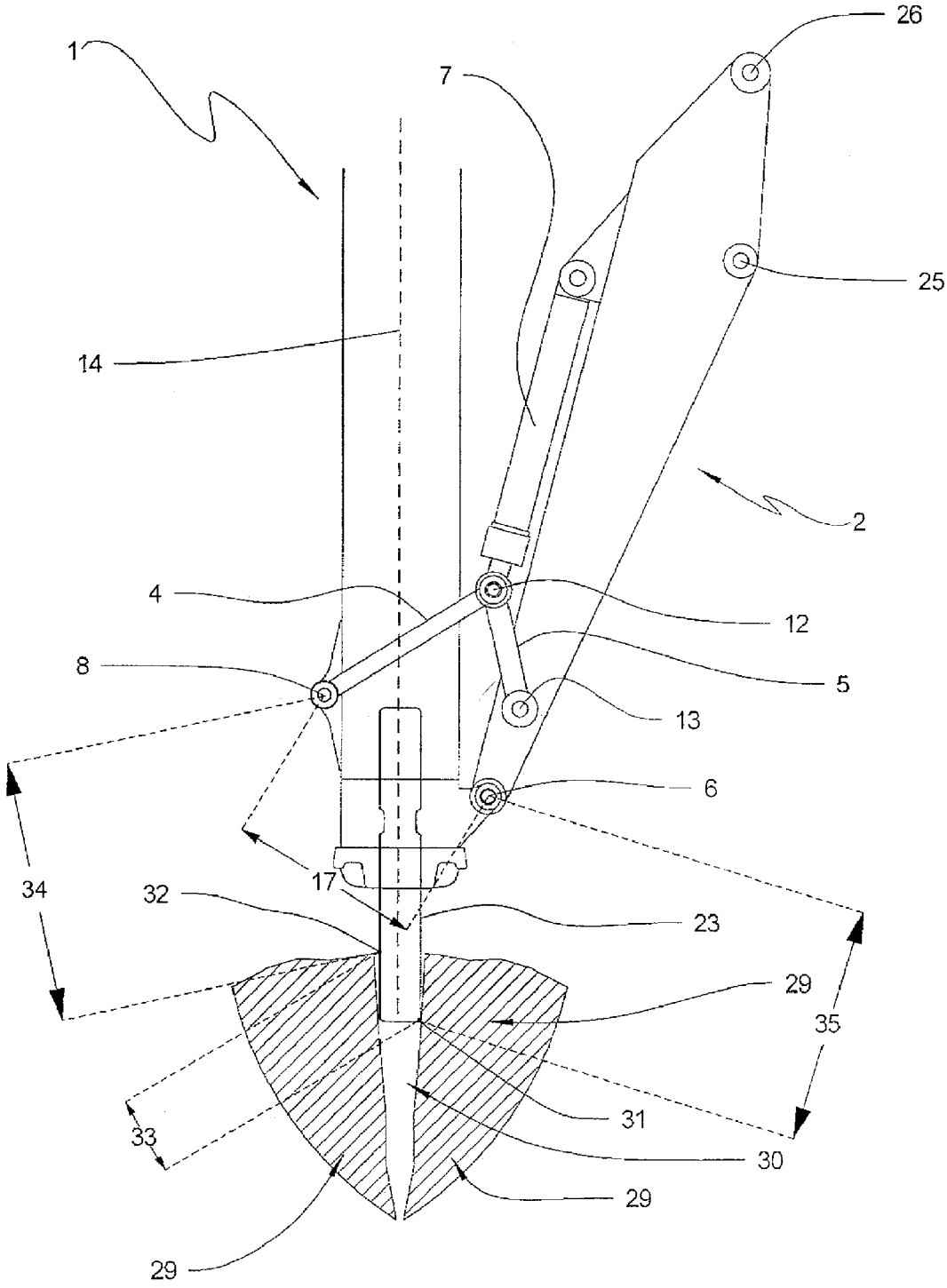
FIG. 8 shows the embodiment illustrated in FIG. 1*a*) in use

FIG. 8 shows the preferred embodiment of FIGS. 1*a*), 2*a*)-*c*), 5*a*)-*c*) in operation. Raking operation simply uses the exposed side of the striker pin (23) projecting from the hammer (1) to push material towards or away from the carrier. When working an embedded rock, the hammer (1) is used to deliver sufficient impacts to a rock (29) to create a crack (30) into which the striker pin tip (31) is inserted up to an intermediate point (32). Rotational movement of the hammer (1) to move the striker pin (23) towards the carrier causes the intermediate position (32) to act as a fulcrum as the striker tip (31) bears on the side of the crack (30) closest the carrier while the intermediate position (32) bears on the opposing side of the crack (30).

Thus, to optimise the mechanical advantage applied to lever the rock (29), it is desirable to make the distance (33) from the striker tip (31) to the intermediate position (32) a minimum, compared to the distance (34) between the intermediate position (32) and the secondary pivot axis (8). In addition to employing an increased torque distance (17), the levering power is also optimised (as per the embodiment of FIGS. 1*a*), 2*a*)-*c*), 5*a*)-*c*) and 8) by minimising the distance (35) from the striker tip (31) to the primary pivot axis (6) by locating the position of the primary pivot axis (6) as close as practicable to the end of the hammer (1), i.e. the hammer nose block.

Minimising the distance (35) between the striker tip (31) to the primary pivot axis (6) also optimises the raking ability of the hammer (1) and arm (2) assembly in addition to minimising the shock loading on the carrier during conventional percussion impacts on the striker pin (23).

A further advantage of the present invention is its ability to be attached to a standard carrier arm with minimal modification and engineering effort. This is illustrated in FIGS. 9*a*)-*c*) and 10*a*)-*c*), respectively showing a prior art installation procedure for a typical drop hammer (1) attachment to the arm (2) and a corresponding attachment sequence for the present invention.

Figure 9:
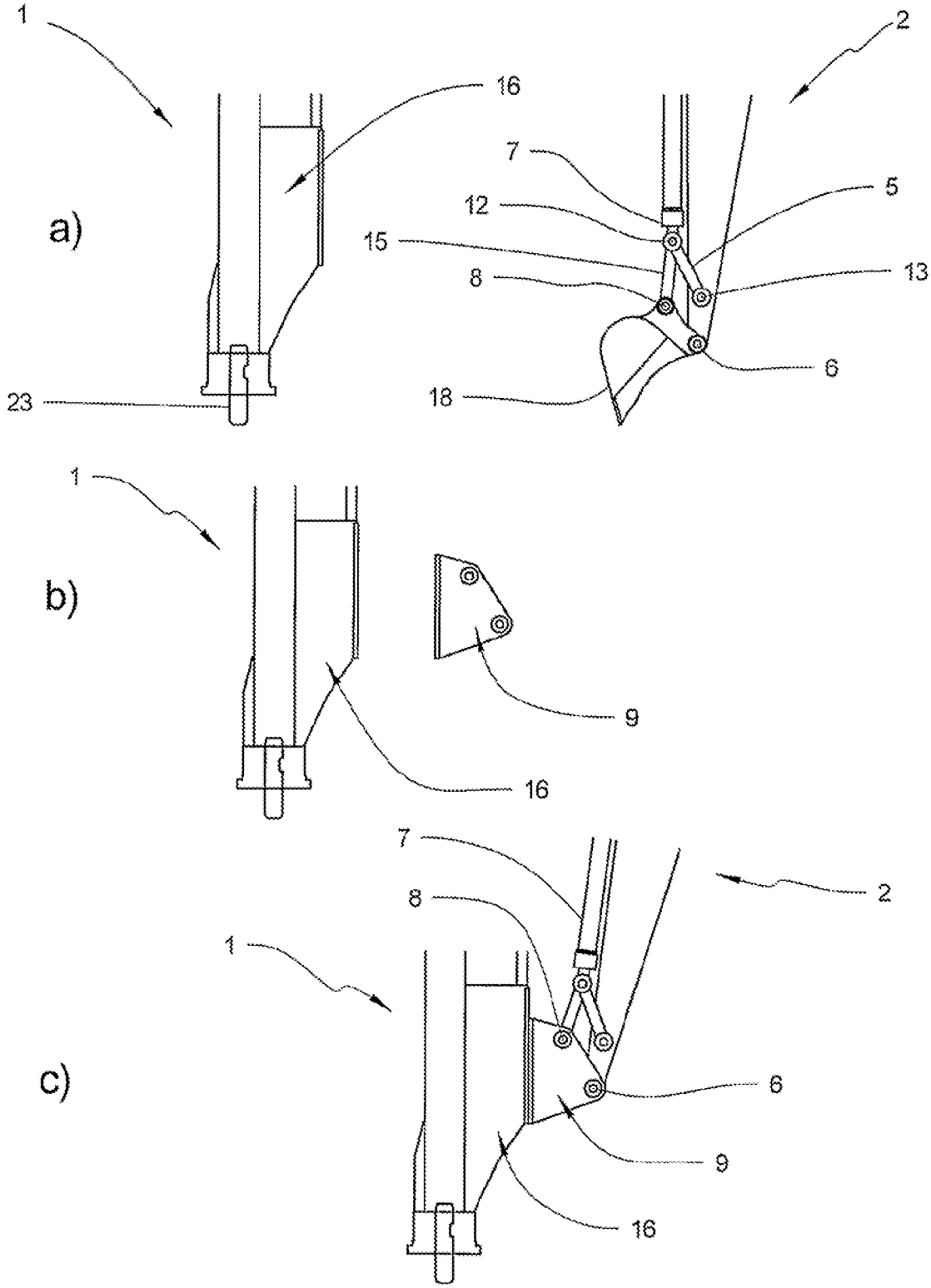
FIG. 9*a-c*) shows a prior art process of attaching an impact hammer to a carrier arm.

FIG. 9 shows a hammer (1) in the form of a gravity drop hammer to be attached to a carrier arm (2) of an excavator (not shown) to replace a standard bucket (18). The carrier arm (2) and bucket (18) are attached together via conventional control linkages (3) in the form of first and second links (4, 5). According to the prior art method, both links (4, 5) are retained on the carrier arm (2) and a customised mounting plate (9) and wing is manufactured to interface between the hammer (1), the first control linkage (4) and the carrier arm (2) at the primary pivot axis (6).

Ensuring the correct geometry to match the particular carrier arm (2) and hammer (1) requires measurement of the distance between the primary pivot axis (6) and secondary pivot axis (8) with the hydraulic ram (7) fully contracted and also measuring the angle formed by a line between the secondary and tertiary pivot axes (i.e. the torque distance (17)) with respect to the vertical. Accurate geometry measurements can be difficult for unqualified staff to perform, leading to expensive delays from misaligned mounting plates (9). A wing (16) portion must also be attached or have been manufactured as part of the hammer (1) to facilitate mounting of the hammer (1) to the mounting plate (9).

Different carriers may have different configurations and thus requirements for mounting the hammer (1) to the carrier arm (2). This means that an individual mounting plate (9) must be made for each type of carrier, typically requiring around a month to design, manufacture and deliver from the date of measuring. It has been found in practice up to ten percent of mounting plates are mis-measured, typically requiring the mounting plate (9) to be taken offsite for remanufacture.

Figure 10:
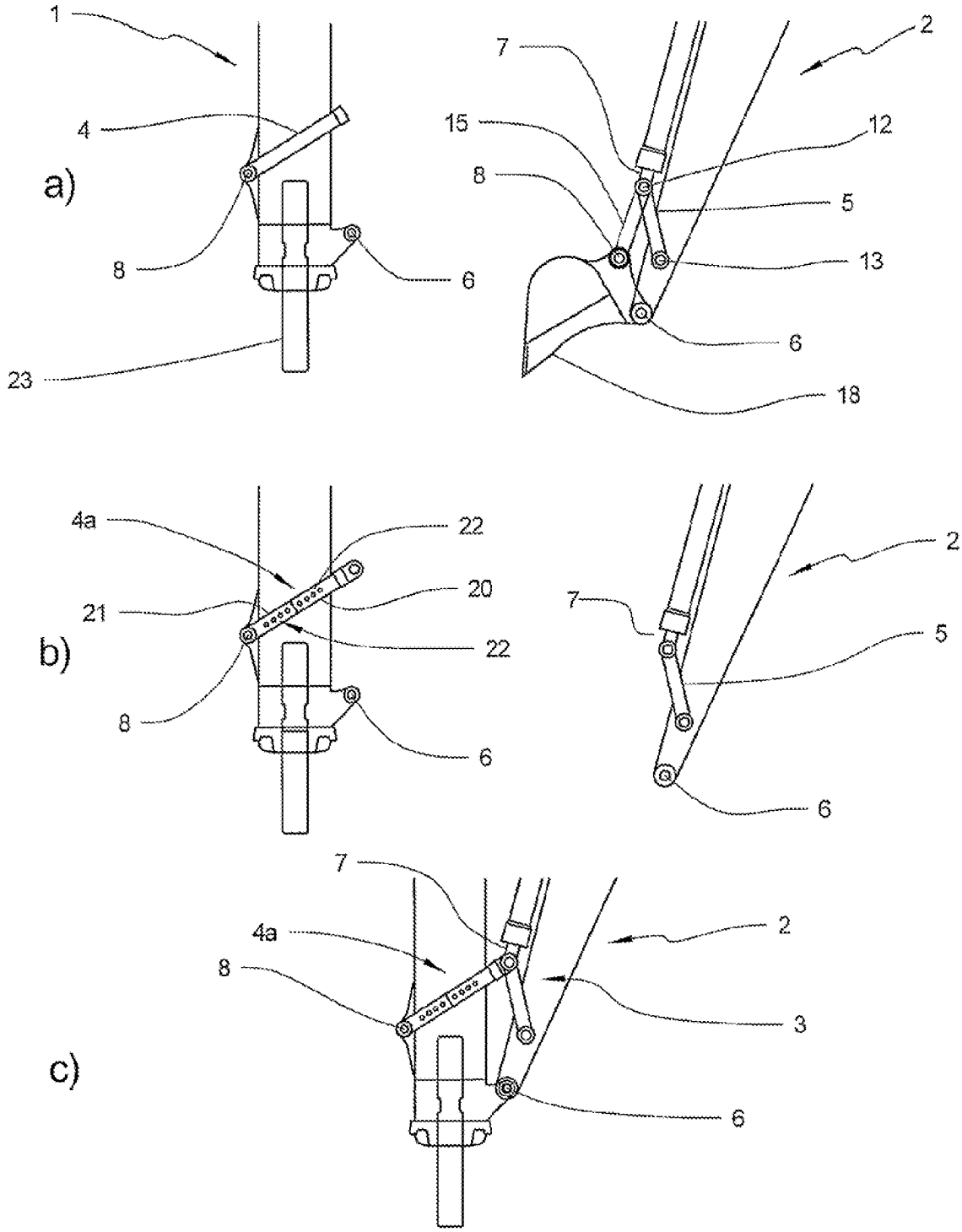
FIG. 10*a-c* shows the process of attaching the embodiment illustrated in FIG. 1*a*) to a carrier arm.

In contrast, attachment of a hammer (1) using the present invention (as shown in FIG. 10*a*)-*c*)) eliminates these difficulties and can be performed with minimal experience without need to manufacture customised mounting plates (9) or the like. As shown in FIG. 10, the hammer (1) is attached to the carrier arm (2) by removing the original first link (15) of the control linkage (3) for replacement by a replacement first link (4), which may be either two fixed arms (as shown in FIG. 10*a*)) if the required length is known, or of adjustable length (as shown I FIGS. 10*b*)-*c*)). Each arm of the first link (4) (one such arm (4*a*) is shown) passes equidistantly around the hammer (1) and is formed from two segments (20, 21) with apertures (22) provided thereon for receipt of bolts or pins or the like. The two segments (20, 21) may be locked together by placing bolts through the apertures (22) in the first and second segments (20 and 21) when the apertures (22) are aligned. The first link (4) is attached at a first end to the hammer (1) on the secondary pivot axis (8) and attached at a second end to both the second link (5) and hydraulic ram (7) at the tertiary pivot axis (12).

Thus, it can be seen that by providing a first link (4) of adjustable length, the control linkage (3) can be adjusted onsite to fit any particular hammer (1) or carrier arm (2) with little operational downtime and minimal engineering, thus the present invention offers substantial cost savings over the state of the art.

In prior art hammer (1) attachments as shown in FIG. 9, a carrier can support a total hammer (1) weight (including wing (16) and mounting plate (9)) of one seventh the weight of the carrier and can carry a maximum impacting weight of twenty five percent of the carrier weight. By removing the need for a mounting plate (9) and wing (16) attachment the total weight of the hammer and attachment is reduced so that the proportion of the hammer weight formed by the impacting weight can be increased. Moreover, the distance from the carrier pivot point multiplies the effect of the weight reduction on the power-to-weight ratio of the carrier. In typical examples of the present invention this increases the ratio of impacting weight:total weight to over thirty five percent. This is a power-to-weight improvement of over forty percent Therefore, by eliminating the need for a wing (16) and mounting plate (9) the power-to-weight ratio of the carrier is increased allowing a greater breaking power for a given carrier.

What is claimed:

1. A hammer assembly for breaking, levering and raking material, said hammer assembly including:

an impact hammer including:

a movable mass capable of linear reciprocating movement for impact along an impact axis, an elongated tool received within the hammer assembly, said tool having a longitudinal axis substantially parallel or coaxial with said impact axis, said tool having two opposed ends with one end projecting from the hammer assembly to form an operative tool head for use during said levering and/or raking operations;

a primary pivot attachment point adapted for attaching the hammer to a distal end of an operating arm attached to a carrier for pivotal movement of the hammer about a primary axis orthogonal to said impact axis;

an articulated control linkage including first and second links for effecting said pivotal movement of the hammer about said primary axis in response to movement from a drive attached to said operating arm, said first link being pivotally attachable:

to said hammer at a first end to form a secondary pivot axis parallel to said primary axis, at a second end to said drive forming a tertiary pivot point axis and to said second link, said second link being pivotally attachable at a first end to the operating arm forming a quaternary pivot axis parallel to said secondary and tertiary axes, at a second end to said second end of said first link and at a second end to said drive, characterised in that;

said primary, tertiary and quaternary pivot axes are all located on an opposing side of said impact axis to said secondary pivot axis, and said first link includes a pair of arms, spaced apart to receive the hammer therebetween.

2. A hammer assembly as claimed in claim 1, wherein said elongated tool is slideably coupled to the hammer assembly and formed separately from said moveable mass.

3. A hammer assembly as claimed in claim 2, wherein the slideable coupling includes at least one retaining pin engageable with a corresponding projection or indentation to define limits of allowable travel of the tool along the impact axis.

4. A hammer assembly as claimed in claim 2, wherein the slideable coupling includes one or more of a resilient mounting, or biasing means including an elastomeric coupling or spring or buffer.

5. A hammer assembly as claimed in claim 1, wherein said pair of spaced-apart arms symmetrically encircles the hammer.

6. A hammer assembly as claimed in claim 1, wherein said first link includes a pair of jaws or other encircling members pivotally coupled to the hammer.

7. A hammer assembly as claimed in claim 1, wherein said quaternary pivot axis is coaxial with said primary pivot axis.

8. A hammer assembly as claimed in claim 1, wherein the primary pivot point is at a distal end of said operating arm with the quaternary pivot point and second link located at an intermediate position between the primary pivot point and the drive.

9. A hammer assembly as claimed in claim 1, wherein the first link is pivotally coupled to the outermost edge of the hammer relative to the operating arm.

10. A hammer assembly as claimed in claim 1, wherein said primary pivot point is located in a region between the tool head and a line subtended orthogonally from the impact axis from the end of the tool distal to the tool face.

11. A hammer assembly as claimed in claim 1, wherein the length of the first and/or second links is adjustable.

12. A hammer assembly as claimed in claim 11, wherein the length of the first and/or second links is adjustable by a releasable locking mechanism capable of locking the length of the link for any given incremental change in length.

13. A hammer assembly as claimed in claim 1, wherein each arm of the first link is formed from two or more joined segments.

14. A hammer assembly as claimed in claim 13, wherein each arm is formed from first and second segments each having a plurality of apertures incrementally spaced apart on a longitudinal axis for receipt of one or more fasteners.

15. A hammer assembly as claimed in claim 1, wherein said articulated control linkage includes a tie member bridging the arms of the first link.

16. A hammer assembly as claimed in claim 1, wherein said first and second link subtend an angle between 60-150° at the tertiary pivot axis on the opposing side to said drive during rotation of the hammer about the primary axis.

17. A hammer assembly as claimed in claim 1, wherein the separation of the primary pivot axis orthogonally from the impact axis is less than the overall length of said tool.

18. A control linkage attachable to a carrier and an impact hammer for breaking, levering and raking material, said hammer including:

a movable mass capable of linear reciprocating movement for impact along an impact axis, an elongate tool received within a hammer assembly, said tool having a longitudinal axis substantially parallel or coaxial with said impact axis, said tool having two opposed ends with one end projecting from the hammer assembly to form an operative tool head for use during said levering and/or raking operations;

a primary pivot attachment point adapted for attaching the hammer to a distal end of an operating arm attached to the carrier for pivotal movement of the hammer about a primary axis orthogonal to said impact axis;

characterised in that said control linkage includes a first link for effecting said pivotal movement of the hammer about said primary axis in response to movement from a drive attached to said operating arm, said first link being pivotally attachable:

to said hammer at a first end to form a secondary pivot axis parallel to said primary axis, at a second end to said drive forming a tertiary pivot point axis, and to a second link, pivotally attached at a first end to the operating arm forming a quaternary pivot point axis parallel to said secondary and tertiary axes, and at a second end to said drive wherein said first link is attachable at said second end to said second end of said second link such that said primary, tertiary and quaternary pivot axes are all located on an opposing side of said impact axis to said secondary pivot axis and said first link includes a pair of arms, spaced apart to receive the hammer therebetween.

19. A carrier having an articulated operating arm attached to an impact hammer assembly for breaking material, said hammer assembly including:

a hammer including:

a movable mass capable of linear reciprocating movement for impact along an impact axis, an elongate tool received within the hammer assembly, said tool having a longitudinal axis substantially parallel or coaxial with said impact axis, said tool having two opposed ends with one end projecting from the hammer assembly to form an operative tool head for use during said levering and/or raking operations;

a primary pivot attachment point attached to the hammer and to a distal end of the operating arm for pivotal movement of the hammer about a primary axis orthogonal to said impact axis;

an articulated control linkage including first and second links for effecting said pivotal movement of the hammer about said primary axis in response to movement from a drive attached to said operating arm, said first link being pivotally attached to the hammer at a first end to form a secondary pivot axis parallel to said primary axis, said first link being pivotally attached at a second end to both said second link and to said drive forming a tertiary pivot point axis, said second link also being pivotally attached at a first end to the operating arm forming a quaternary pivot point axis parallel to said secondary and tertiary axes, said second link being pivotally attached at a second end to said second end of said first link and to said drive at said tertiary pivot point, characterised in that;

said primary, tertiary and quaternary pivot axes are all located on an opposing side of said impact axis to said secondary pivot axis; and said first link includes a pair of arms, spaced apart to receive the hammer therebetween.

20. A method of attaching a hammer assembly as claimed in claim 1 to a carrier arm, said method including;

decoupling any existing hammers attached to said arm by said primary pivot point and an existing control linkage, removing any existing first linkage, pivotally coupling the impact hammer assembly to the carrier at the primary pivot point, pivotally attaching a new first linkage extending between the secondary and tertiary pivot axes.

21. The method as claimed in claim 20 wherein said new first linkage is adjusted for length to correspond with the separation between the secondary and tertiary pivot axes.

* * * * *